US006354824B1

(12) United States Patent
Mills

(10) Patent No.: US 6,354,824 B1
(45) Date of Patent: Mar. 12, 2002

(54) CERAMIC HARDFACING FOR PROGRESSING CAVITY PUMP ROTORS

(75) Inventor: Robert A. R. Mills, Bragg Creek (CA)

(73) Assignee: Kudu Industries, Inc. (CA)

( * ) Notice: Subject to any disclaimer, the term of this patent is extended or adjusted under 35 U.S.C. 154(b) by 0 days.

(21) Appl. No.: 09/522,146

(22) Filed: Mar. 9, 2000

(51) Int. Cl.[7] ..... F03C 2/00

(52) U.S. Cl. ..... 418/152; 418/48; 418/178; 427/355; 428/457

(58) Field of Search ..... 418/48, 152, 178; 427/355; 428/457

(56) References Cited

U.S. PATENT DOCUMENTS 3,844,800 A * 10/1974 Hooton ..... 264/111
4,671,740 A 6/1987 Ormiston et al.
4,877,985 A * 10/1989 Byrd et al. ..... 310/86
4,911,987 A * 3/1990 Sakata et al. ..... 428/469
5,395,221 A 3/1995 Tucker, Jr. et al.
5,498,142 A 3/1996 Mills
5,645,896 A 7/1997 Mills

* cited by examiner

*Primary Examiner*—Thomas Denion
*Assistant Examiner*—Theresa Trieu
(74) *Attorney, Agent, or Firm*—Pendorf & Cutliff

(57) ABSTRACT

A hardfacing for downhole progressing cavity pumps is disclosed as well as a method for producing same. The hardfacing consists of a ceramic layer applied to a ferrous pump rotor body by way of plasma spraying and a top layer of metallic material having a lower hardness than the ceramic. The ceramic layer has a grainy surface with a plurality of peaks and intermediate depressions, the peaks being formed by ceramic grains at the surface of the ceramic layer. The thickness of the top layer is adjusted such that the depressions between the peaks of the ceramic layer are completely filled thereby providing the rotor with a ceramic hardfacing of significantly reduced surface roughness. In the process of the invention, the pump rotor, which may be provided with a molybdenum bonding layer, is plasma coated with the ceramic and the resulting ceramic layer is covered with the metallic material top layer. The top layer is polished either until the dimensions thereof are within the tolerances acceptable for the finished rotor or until a majority of the peaks of the ceramic layer are exposed.

8 Claims, 2 Drawing Sheets

CERAMIC HARDFACING FOR PROGRESSING CAVITY PUMP ROTORS

FIELD OF THE INVENTION

The invention relates to wear-resistant hardfacings for movable parts and especially to hardfacings for rotors of progressing cavity pumps.

BACKGROUND OF THE INVENTION

Progressing cavity pumps have been used in water wells for many years. More recently, such pumps have been found well suited for the pumping of viscous or thick fluids such as crude oil laden with sand. Progressing cavity pumps include a stator which is attached to a production tubing at the bottom of a well and a rotor which is attached to the bottom end of a pump drive string and is made of metallic material, usually high strength steel. The rotor is usually electro-plated with chrome to resist abrasion, but the corrosive and abrasive properties of the fluids produced in oil wells frequently cause increased wear and premature failure of the pump rotor. Since it is important for efficient operation of the pump that a high pressure differential be maintained across the pump, only small variations in the rotor's dimensions are tolerable. This means that excessively worn rotors must be replaced immediately. However, replacement of the rotor requires pulling a whole pump drive string from the well which is costly, especially in the deep oil well applications which are common for progressing cavity pumps. Consequently, pump rotors with increased wear resistance and, thus, a longer service life are desired to decrease well operating cost.

Various hardfacing methods have been used in the past to increase the wear resistance of metal surfaces. Hardfacings consisting of a thin layer of metal carbide applied by conventional thermal spraying techniques are the most commonly used due to the extreme hardness of the coating achieved. However, although this type of hardfacing works well when in friction contact with a metal surface, surfaces so coated have a roughness which makes them unacceptable for use in progressing cavity pump applications. The surface roughness of the metal carbide hardfacing is due to the grainy structure of the hardfacing structure which is caused by the individual sprayed-on metal carbide particles. This roughness results in excessive wear of the progressing cavity pump stator which is made of an elastomeric material, most often rubber. Polishing of the metal carbide hardfacing to overcome this problem is theoretically possible, but cannot be done economically due to the extreme hardness of the material. Thus, an economical hardfacing for progressing cavity pump rotors is desired which increases the surface life of the rotor without increasing stator wear. In particular, a hardfacing is desired which provides the surface hardness and wear characteristics of a metal carbide that is substantially insoluble in corrosive solutions found in wells.

Coating a metal component with a thin layer of a ceramic material or another metal is known. One primary purpose of a coating process is to protect the surface of a fragile metal product or substrate from abrasion or thermal degradation (i.e., melting) or oxidation by coating it with a more abrasion resistant and thermal degradation resistant material. Recently, various ceramics having high abrasion resistance or high oxidation resistance characteristics have been used to coat metal substrates. One method for applying a ceramic coating to the substrate is by spraying the ceramic coating onto the substrate.

Early equipment used for the spray-coating process, which typically is called flame spraying, included a wire-type flame sprayer. Flame spraying involves heating a heat fusible material, such as metal, to the point where it can be atomized and propelled through the gun onto the surface to be coated. The heated particles strike the surface and bond to it. In the typical flame spray gun, the acetylene and oxygen act as the fuel and combustion gas, respectively, creating the flame. Flame spraying includes oxyacetylene torch spraying. Examples of coatings produced by the flame spraying gun process are found in Ingham, H. S. & A. P. Shepard, Flame Spray Handbook, Vol. II (Metco Inc.)(2d ed 1964). The protective coatings that can be applied this way are limited to those materials that can be formed into a wire or rod. Commercially available flame spray guns also permit the use of a wide variety of metals, alloys, ceramics and cements which can be ground into a relatively fine powder to coat the object. However, high melting point materials are merely cemented by a matrix of material which can be melted in the flame plume. The typical flame spray gun is designed to apply self-fluxing alloys, self-bonding alloys, as well as oxidation-resistant alloys. The flame spray gun utilizes combustion to produce the necessary heat to melt the coating material. Other heating means such as electric arcs and resistance heaters may also be used in a flame spray gun.

In a plasma spray gun, the primary plasma gas is generally an inert gas such as nitrogen or argon. The gas mixture is heated by passing between electrodes with a high voltage discharge. A powder reservoir is attached to the gun and an a water cooler may be attached to the gun to prevent over-heating. Some metal powders require a triggered vibrator to maintain powder movement from the powder reservoir to the gun. The gun can either be "hand-held" or attached to a lathe for larger work, which rotates the metal component to be coated. Typically, the gun is perpendicular to the surface of the rotating object to be sprayed.

The plasma spray gun is the most versatile thermal spraying technique and produces enough heat to plasticize ceramic powder particles. The high thermal efficiency of the plasma spraying gun makes it possible to spray refractory materials at rates and deposit efficiencies which make the coatings economically feasible. The plasma spray technique can produce plume temperatures of 20,000 to 30,000 degrees and velocities of up to Mach 2.

However, ceramic coatings may be porous and may not afford much oxidation or corrosion protection to the base material. Therefore an undercoat of an oxidation-resistant or corrosion-resistant metal or alloy may be used between the base material and the ceramic coating.

Typically, ceramic coatings having high thermal resistance, have a lower wear resistance, while ceramic coatings having a high wear resistance have a low thermal resistance. The general reason for this relationship is that ceramic coatings having a high thermal resistance typically are more sponge-like and have a higher void content allowing thermal dissipation yet allowing easier abrasion, while ceramic coatings having a high abrasion resistance have a lower void content, thus reducing abrasion while at the same time lowering the heat dissipation properties.

Other melting spraying techniques are High Velocity Oxygen Fuel (HVOF) and Detonation Gun (D-gun).

In the HVOF technique, oxygen and a combustible fuel, either a gas or a liquid, are continuously injected into a combustion chamber and continuously ignited. The combustion gases are directed down a barrel and form a plume at the exit. The metal powder is injected into the plume axially in the barrel. This technique permits more efficient mixing of the metal powder in the plume, and may achieve plume velocities of up to Mach 3. The high velocity results in a coating having low porosity and permeability, and a compression coating is achieved which is more resistant to cracking if the part flexes. However, the lower temperature of the plume limits the use with ceramics.

In the D-gun, oxygen and a combustible gas are injected into a combustion chamber in an explosive mixture with a metal powder. The mixture is detonated and the combustion gases and metal are accelerated down a long barrel. This technique produces a high velocity plume compound to other metal spraying techniques, and a lower temperature than plasma and HVOF spraying.

The present invention is intended to included the use of any suitable thermal spraying technique, but plasma spraying is preferred.

U.S. Pat. No. 4,671,740 issued Jun. 9, 1987 to Ormiston et al. states that flame spraying a powder to produce a ceramic coating material on a metal substrate member results in porous coatings of low density that are not sufficiently abrasion resistant. U.S. Pat. No. 4,671,740 teaches the application of many small ceramic tiles that are bonded with an organic plastic adhesive to internal pump surfaces which is a complex, and time consuming process.

Therefore, one skilled in the art will appreciate that there is a need for more durable pump rotors for progressive cavity pumps and for a method for the ceramic coating of metal substrates which results in improved thermal resistance and improved wear resistance. The present invention now provides a hardfacing for a progressing cavity pump rotor which reduces problems of stator wear and corrosion experienced in progressing cavity pumps having rotors with metal carbide hardfacings.

U.S. Pat. Nos. 5,645,896 and 5,498,142 issued on Jul. 8, 1997 and Mar. 12, 1996 respectively to Robert A. R. Mills and commonly assigned to the present applicant disclose a hardfacing for downhole progressing cavity pumps and a method for producing the same. The hardfacing consists of a metal carbide layer applied to the ferrous pump rotor body by way of plasma spraying and a top layer of metallic material having a lower hardness than the metal carbide. The metal carbide layer has a grainy surface with a plurality of peaks and intermediate depressions, the peaks being formed by metal carbide grains at the surface of the metal carbide layer. The thickness of the top layer is adjusted such that the depressions between the peaks of the metal carbide layer are completely filled thereby providing the rotor with a metal carbide hardfacing of significantly reduced surface roughness. In the process of the invention, the pump rotor, which may be provided with a molybdenum bonding layer, is plasma coated with the metal carbide and the resulting metal carbide layer is covered with the metallic material top layer. The top layer is polished either until the dimensions thereof are within the tolerances acceptable for the finished rotor or until a majority of the peaks of the metal carbide layer are exposed.

Previously, it was believed that a ceramic would not function well sandwiched between two metal layers. It has now been found that a ceramic sandwiched between metals provides good resistance to abrasion and acts as a barrier to corrosion.

It would be advantageous to provide a hardfacing that is an improvement over metal carbides, in particular tungsten carbide, In addition, it would be advantageous to provide a hardfacing that has improved corrosion resistant/chemical resistant properties than metal carbides.

It has now been found that by hardfacing a downhole progressing cavity pump with a ceramic provides a rotor surface of greater durability to wear and corrosion.

SUMMARY OF THE INVENTION

It is an object of the invention to provide a progressing cavity pump of increased service life having a ceramic coating.

It is yet another object of the invention to provide an economical ceramic hardfacing for a progressing cavity pump rotor which has a low surface roughness.

These and other objects which will become apparent from the following are achieved with a hardfacing for a progressing cavity pump rotor in accordance with the invention. The hardfacing includes a layer of hard wearing ceramic bonded to the metal body of the rotor and may be overlaid by a top layer of a softer metallic material, either a pure metal or a metal alloy, which is polished more readily than the ceramic coating. Such a top layer may be applied at sufficient thickness to fill in the roughness of the ceramic layer or completely cover the first layer, and may be subsequently polished to a smooth finish having dimensions within desired tolerances. Preferably, the top layer is polished until a majority of the peaks of the grainy ceramic layer are exposed. This provides the rotor with a running surface which has the hard wearing characteristics but not the surface roughness of a pure ceramic coating, since the grainy surface structure of the ceramic layer is filled in by the metallic material of the second layer.

In one embodiment of the ceramic is material is a metal oxide, preferably alumina. In another embodiment, the ceramic material is applied by plasma spraying.

In one aspect the invention provides a pump rotor for a progressing cavity pump comprising a rotor body made of a ferrous metal and a coating on the ferrous metal comprising a ceramic metal oxide layer.

In another aspect, the invention provides a pump rotor for a progressing cavity pump comprising: (i) a rotor body made of a ferrous metal; (ii) a layer of a ceramic material plasma sprayed onto the body to form a ceramic layer, the ceramic layer having a grainy surface with a plurality of peaks and intermediate depressions, the peaks being formed by ceramic grains at the surface of the ceramic layer; and optionally, (iii) a top layer of metallic material bonded to the ceramic layer, the thickness of the top layer adjusted such that the depressions between the peaks of the ceramic layer are filled while a majority of the peaks are exposed at the surface of the rotor, thereby providing the rotor with a ceramic hardfacing.

The invention further provides a ceramic hardened metal surface comprising: (i) a ferrous metal body; (ii) a layer of a ceramic material plasma sprayed onto the ferrous metal body to form a ceramic layer, the ceramic layer having a grainy surface with a plurality of peaks and intermediate depressions, the peaks being formed by ceramic grains at the surface of the ceramic layer; and (iii) a top layer of metallic material bonded to the ceramic layer, the thickness of the top layer adjusted such that the depressions between the peaks of the ceramic layer are filled while a majority of the peaks are exposed at the surface of the rotor, thereby providing the metal body with a ceramic hardfacing.

The present invention also extends to a method of hardfacing a rotor for a progressing cavity pump having a ferrous metal rotor body comprising the step of: (i) plasma spraying a ceramic material onto the rotor body to form a ceramic layer on the rotor body having a grainy surface with a multiplicity of peaks and intermediate depressions, the peaks being formed by ceramic grains at the surface of the ceramic layer. Preferably the method further comprises the step of (ii) applying a metallic material top layer onto the ceramic layer at such a thickness that it substantially covers the ceramic layer; and (iii) polishing the top layer until a majority of the peaks of the ceramic layer are exposed.

In one embodiment, the top layer is of sufficient thickness to completely cover the ceramic layer and is made of a pure metal or a metal alloy. In addition, a molybdenum layer is applied directly onto the rotor body and prior to application of the ceramic layer to increase the bonding of the latter to the rotor body. The ceramic layer is preferably applied at such a thickness that the dimensions of the ceramic layer are within the tolerances selected for the finished rotor.

In a preferred economical embodiment, the top layer is not polished until the majority of peaks of the ceramic layer are exposed. The ceramic layer is applied so that its dimensions are within the selected tolerances for the finished rotor. The top layer is polished to achieve a smooth surface and only until the interference between the finished rotor and the stator is within acceptable limits. The rotor is put into service whereby the top layer is subjected to the usual wear experienced with conventional rotors. Then once the top layer is worn to the point where a majority of the peaks of the ceramic layer are exposed, the interference fit between the rotor and the stator is still satisfactory since the dimensions of the ceramic layer are within the selected tolerances for the finished rotor.

The ceramic material is preferably selected from among the ceramics formed from aluminium, boron, silicon, or titanium and the metallic material of the top layer is preferably selected from among chromium, molybdenum and nickel and alloys thereof. In the preferred embodiment, the ceramic layer is made of aluminium oxide or alumina and the second layer is made of chromium/molybdenum alloy or nickel/chromium alloy. Most preferably, the ceramic layer is presently achieved with an aluminium oxide layer having a thickness of 50 to 125 $\mu$m (microns/micrometers) and overlayed with a nickel/chromium layer of 75 to 150 $\mu$m.

BRIEF DESCRIPTION OF THE DRAWINGS

The invention will be described in more detail in the following by way of example only and with reference to the attached drawings wherein.

DETAILED DESCRIPTION OF THE INVENTION

Figure 1:
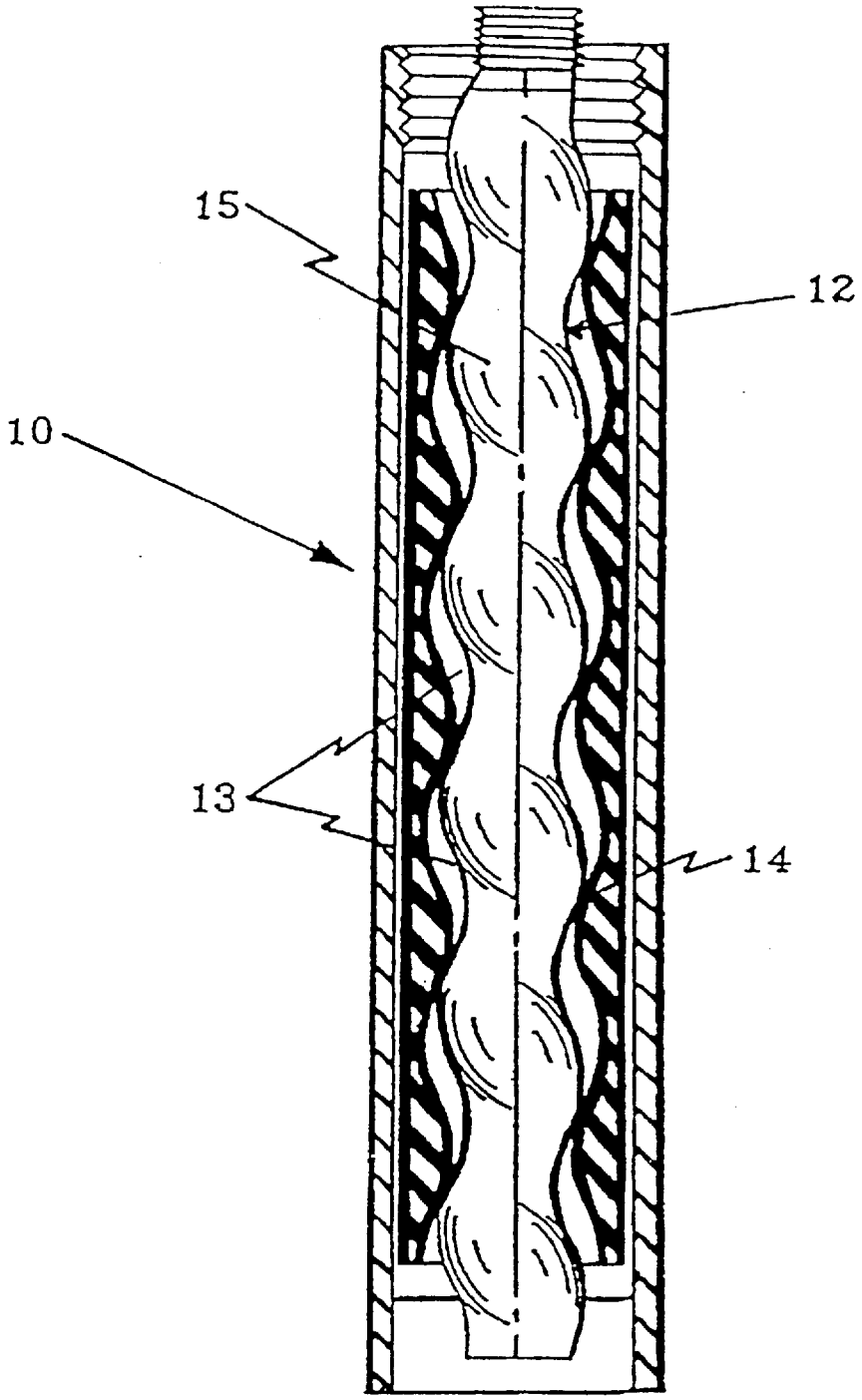
FIG. 1 shows the principal construction of a progressing cavity pump.

In the preferred embodiment, the hardfacing in accordance with the invention has a ceramic layer, preferably of a metal oxide, applied to a ferrous pump rotor body, preferably by way of plasma spraying and a top layer of corrosion resistant metallic material having a lower hardness than the ceramic. The ceramic layer has a grainy surface with a plurality of peaks and intermediate depressions, the peaks being formed by ceramic grains at the surface of the ceramic layer.

The thickness of a top layer is adjusted such that the depressions between the peaks of the ceramic layer are completely filled thereby providing the rotor with a ceramic/metal hardfacing of significantly reduced surface roughness. The top layer also serves to reduce porosity, if present, of the ceramic layer.

In the preferred embodiment of the process of the invention, the pump rotor, which may be provided with a molybdenum bonding layer, is plasma coated with the ceramic and the resulting ceramic layer is covered with the metallic material top layer. The top layer is polished either until the dimensions thereof are within the tolerances acceptable for the finished rotor or until a majority of the peaks of the ceramic layer are exposed. The metallic material top layer also serves to retain the integrity of the ceramic layer. The ceramics and metal powders used to coat a substrate are preferably of the highest purity and the finest grain size available.

The wear resistant ceramics used for engineering applications today are often synthetic. They have been developed, however, from ceramics made from natural minerals including clay, quartz, feldspar, and other common rocks. They were also developed from the engineering ceramics that were first made from porcelain in the late 1800's. Engineering ceramics are categorized in two ways: oxide and non-oxide ceramics.

Oxide ceramics, which are based on oxygen compounds, include metal oxides such as silicon dioxide (silica), aluminum oxide (alumina), zirconium oxide (zirconia), titanium oxide (titania), magnesium oxide (magnesia), and mixed oxides such as zirconia toughened alumina.

Alumina ceramic is considered the "workhorse" of wear resistant ceramics and is probably the best known. Alumina ceramic is hard which makes it especially suitable for applications where abrasives slide across the surface; in fact, only a diamond grinding wheel is hard enough to scratch alumina ceramics. Alumina ceramic is also fine grained and has no open porosity. Alumina ceramic is chemically inert and does not corrode in acidic environments. It is also inexpensive and capable of being pre-formed in a variety of shapes and angles to fit the inside diameter of pipes or chutes. Alumina ceramic is usually classified by its aluminum oxide content. For example, a commonly used alumina ceramic has 90% aluminum oxide and 10% clay or silica binding agents.

Non-oxide ceramics include carbide ceramics such as silicon carbide and boron carbide; nitride ceramics, such as silicon nitride and boron nitride; boride ceramics such as titanium diboride; and sialon (silicon aluminum oxynitride).

The following Table lists the hardness of various wear resistant materials (Knoop approximation).

| Material | Hardness (kg/mm$^2$) |
|---|---|
| Diamond | 7000 to 8000 |
| Boron carbide | 3500 |
| Silicon carbide | 2700 |
| Silicon nitride | 2200 |
| Alumina ceramic | 2000 |
| Tungsten carbide | 1800 |
| Stainless steel (Type 440C) | 600 |

As is apparent from the table above alumina ceramic is approximately 10% harder than tungsten carbide. In addition, alumina ceramic in the form of high density alumina ceramic is preferred for its fine grain size, low porosity, and relatively low cost. Thus, the present invention can provide a rotor with a greater hardness than existing metal carbide rotors. By providing a rotor of greater hardness the time between progressing cavity pump failure is reduced and, consequently, the time between rotor replacement is increased. By increasing the time interval between rotor replacement reduces the number of times a whole pump drive string must be pulled from a well which reduces costs. The reduction of costs is especially important in deep oil well applications which are common for progressing cavity pumps.

It is within the scope of the present invention to mix ceramics or to apply different ceramics in layers. For example, it is possible to apply a final boron carbide layer over an alumina ceramic before the resulting ceramic layer is covered with the metallic material top layer. Boron carbide is almost twice as hard as tungsten carbide and hence a more durable rotor is provided than a tungsten carbide coated rotor.

Resistance of a material to wear is determined by several factors. Some factors are based on the material; some are based on the application, such as the abrasiveness of particles or the angle of impingement. Ceramics used in wear resistance wear by micro-cracks and individual grains popping out. It has been a common misconception in the wear resistance industry that the wear behaviour of alumina, for instance, is determined by mechanical properties, such as hardness, fracture toughness, and the alumina content ($Al_2O_3$). Recent findings of several researchers have shown that microstructural, not macrostructural, properties may be more important in determining the wear resistance performance of aluminas. In order to improve performance, an alumina may be microstructurally engineered to have a small grain size, low porosity, and good cohesion in the intergranular region. A suitable wear resistant alumina ceramic has 90% aluminium oxide content and a grain size of 5 $\mu$m (microns) or less.

Referring to FIG. 1, in a prefelTed embodiment, the hardfacing in accordance with the present invention is applied to the rotor of a progressing cavity pump 10. Progressing cavity pumps usually include a single helical rotor 12 made of ferrous metal, usually high strength steel, and a stator having a generally double helical cavity, rotor receiving bore 15 of twice the pitch length. The dimensions of the rotor and stator are coordinated such that the rotor tightly fits into the bore 15 and a number of individual pockets or cavities 13 are formed therebetween which are inwardly defined by the rotor 12 and outwardly by the stator 14. The stator 14 is generally of elastomeric material suitably shaped. Upon rotation of the rotor 12 in the operating direction, the cavities 13 and their contents are pushed spirally about the axis of the stator 14 to the output end of the pump. The seal between the cavities is made possible by an interference fit between the rotor and the elastomeric material of the stator 14. Since the rotor 12 and stator 14 are at all times in tight contact in the areas between the cavities, this results in the wear of both components and in particular the rotor, especially when sand-laden and corrosive liquids are pumped as is often the case in deep oil well applications.

Experiments have shown that although rotors having only a ceramic coating at the rotor surface can be used, the ceramic coating generally has a grainy surface, which contributes to the wear of the stator. Although a ceramic hardfacing in accordance with the invention may be polished, polishing is uneconomical due to the extreme hardness of the coating. Thus in a preferred embodiment, the ceramic layer is sprayed onto the surface of the rotor, or onto a bond coating on the rotor, by way of a plasma spray gun and overlaid with a layer of metallic material which is polished to fit selected stator dimensions or until a major portion of the peaks of the underlying ceramic layer are exposed.

Thermal spray coating processes and apparatus are well known in the art. A plasma gun generally includes a pair of oppositely charged electrodes and an open-ended plasma chamber with arc-gas injection ports. Upon introduction of a suitable arc-gas, for example argon, and generation of an arc resulting from a current crossing the gap between the electrodes, a zone of intense heat, a plasma, is formed which extends through the plasma chamber and emanates from the open end thereof. The magnitude of the heat in the plasma depends on the size of the electric current and the type of arc-gas used. A plasma-sprayed coating is formed by injecting a metal powder/ceramic powder into the plasma plume through the powder injection port. The powder is heated by the plasma to a molten or plastic condition and projected onto the base metal part to be coated. Upon impact, a bond is formed at the interface between the molten or plastic powder and the base metal part. The term plasma sprayed as used herein is not restrictive to any particular form of powder type deposition/coating and should be construed broadly to encompass any suitable technique to deposit a ceramic coating such as flame spraying, plasma spraying, oxyacetylene torch spraying, thermo-spraying, etc. It is likely that other forms of high velocity spraying of materials for providing a coating will be developed. The term plasma sprayed should be construed to encompass such new methods of coating.

Figure 2:
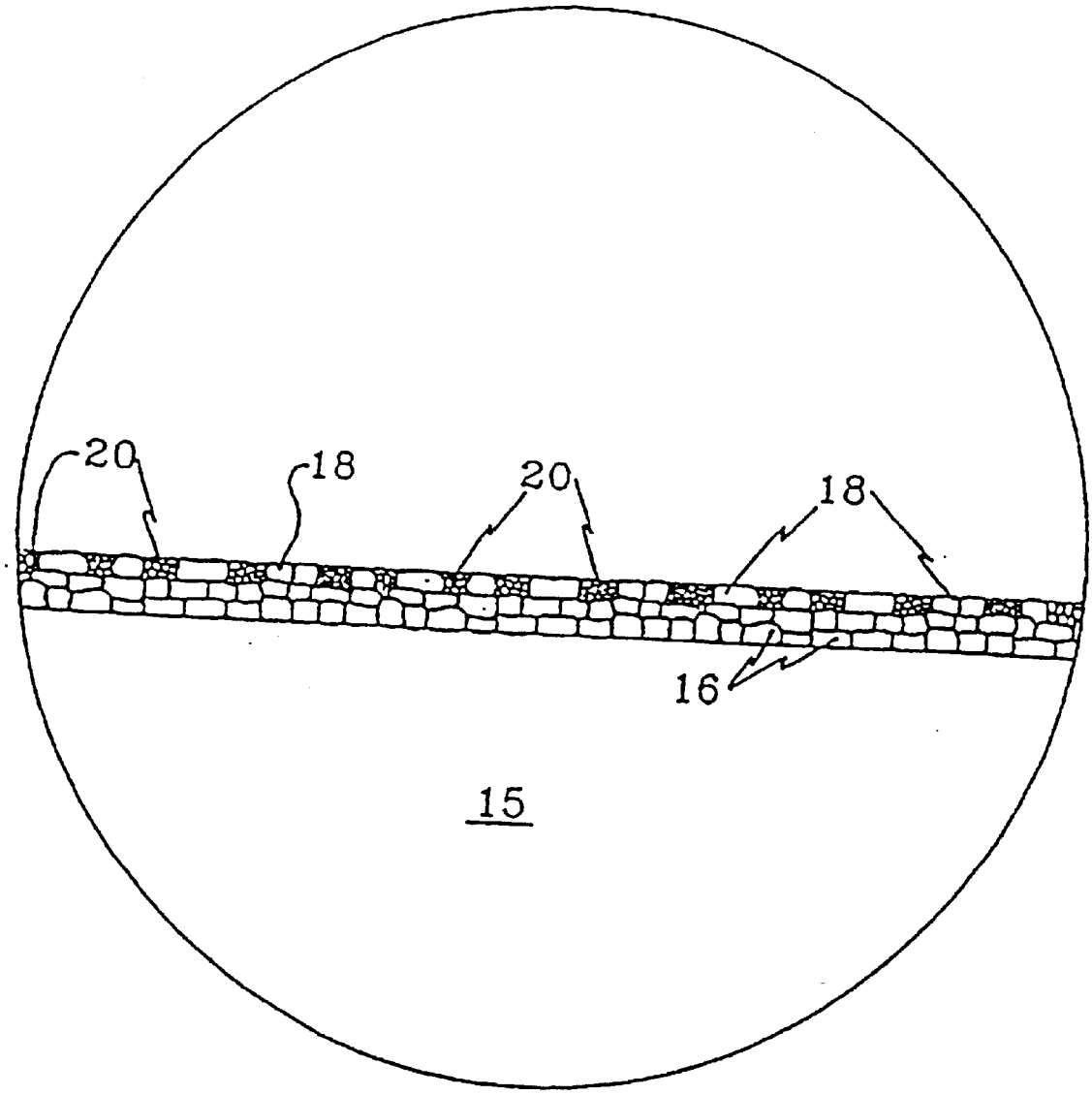
FIG. 2 shows a partial cross-sectional view of a progressing cavity pump rotor provided with a ceramic hardfacing in accordance with the present invention showing in magnification the particles of the ceramic and metal alloy layers in the hardfacing.

Referring to FIG. 2, a magnification of the interface between the metal rotor body 15 and the hardfacing is shown in accordance with the invention. Ceramic powder particles 16 are bonded to the rotor body 15 and form a continuous layer. Those powder particles which were deposited last protrude from the ceramic layer and provide the layer with a grainy surface having peaks 18 and intermediate depressions. In the preferred embodiment of the hardfacing in accordance with the invention, the ceramic layer is made of high density alumina ceramic and the depressions in the surface thereof are completely filled with metal alloy particles (20), preferably nickel/chromium alloy particles. This greatly reduces the surface roughness of the ceramic layer. Metal alloy powder is coated onto the ceramic layer by plasma-spraying or other conventional coating process, such as electroplating, until full coverage is achieved, which means no more ceramic particles are exposed. After cooling of the rotor, the metal alloy layer, which has a much lower hardness than the ceramic layer, is polished smooth or until a major portion of the peaks 18 of the ceramic layer are exposed. At that point, the surface of the rotor body 15 includes alternating ceramic and metal alloy portions, since the depressions between the peaks are completely and evenly filled with metal alloy particles 20. Preferably, polishing equipment is used which is suited for polishing the metal alloy, but unsuited for the polishing the underlying ceramic. This results in an automatic slowdown or termination of the polishing operation once a majority of the peaks 18 are exposed.

It is within the scope of the invention to treat the surface of the rotor body 15 with a hydrophobic agent to reduce migration of water soluble components to underlying layers of the rotor body 15. In the case of ceramics of lower quality, i.e., having some porosity, it is possible to treat the ceramic with the hydrophobic agent, for example a high temperature resistant silane.

The invention is further described by the following example which one skilled in the art will appreciate is applicable to other metal surfaces other than the rotor body 15.

EXAMPLE

In a first coating step, a powder containing more that 99.5% molybdenum and having a particle size of maximum 1%+170 mesh and minimum 80%+325 mesh was injected into a Miller SP 100 plasma gun and coated onto a 35 mm×51 mm minor and major diameter stainless steel Moineau pump rotor (200TP1200) to a thickness of 50 $\mu$m. In a second coating step, coating powder containing 90% Alumina ($Al_2O_3$) and having a particle size of 5 microns or less was injected into the same plasma. The distance of the plasma gun nozzle from the rotor surface was maintained at 7–10 cm. The powder injection rate was 3–5 grs/min at 100 kW of DC power. This resulted in a ceramic coating on the rotor of 100 $\mu$m (micrometers) thickness, after several coats were applied.

In a third coating step, a coating powder containing 20% chromium and 78.5% nickel and having a particle size of 91.7%–325 mesh was injected into the same plasma gun and coated onto the ceramic layer produced in the second coating step. The distance between the plasma gun nozzle and the rotor was kept at 7–10 cm. The powder injection rate was 3.2 grs/min at 100 kW of DC power. The resulting nickel/chromium coating had a thickness of about 125 $\mu$m, after several coats. Polishing of the coated rotor was carried out on a conventional carriage mounted belt polishing machine until about 50% of the peaks of the ceramic layer were exposed.

The rotor thus obtained was tested in a deep oil well situation and used to pump highly viscous crude oil which contained corrosive agents and had a sand content of about 5%. The rotor proved to have a 70 times longer service life than conventional chrome-plated, high strength steel rotors of corresponding size.

Although the hardfacing method of the invention has been described in detail only for the combination of a ceramic based layer filled in with a nickel/chromium alloy, one skilled in the art will readily appreciate that it is possible to use other ceramic/metal alloy combinations as long as the metal alloy respectively used has a lower hardness than the ceramic with which it is combined. For example the ceramics derived from of aluminium, zirconium, boron, and silicon, are advantageously overlaid with stainless steel, alloys of chrome, molybdenum and nickel, especially chrome/molybdenum and nickel/chromium alloys. Furthermore, it is possible to use any conventional coating process adapted for the coating of a ceramic surface with a layer of a metallic material for the application of the top layer.

Changes and modifications in the specifically described embodiments can be carried out without departing from the scope of the invention which is intended to be limited only by the scope of the appended claims.

What is claimed is:

1. A pump rotor for a progressing cavity pump comprising:

a rotor body made of a ferrous metal;

a layer of a ceramic material plasma sprayed onto the body to form a ceramic layer, the ceramic layer having a grainy surface with a plurality of peaks and intermediate depressions, the peaks being formed by ceramic grains at the surface of the ceramic layer; and a top layer of metallic material bonded to the ceramic layer, the thickness of the top layer adjusted such that the depressions between the peaks of the ceramic layer are filled while a majority of the peaks are exposed at the surface of the rotor, thereby providing the rotor with a ceramic hardfacing.

2. The pump rotor according to claim 1, wherein the ceramic material is selected from the group consisting of oxides of aluminium, boron, titanium, silicon and zirconium and the metallic material of the top layer is selected from the group consisting of chromium, molybdenum, nickel and alloys thereof.

3. A pump rotor according to claim 1, wherein the metallic material of the top layer is selected from the group consisting of chrome/molybdenum and nickel/chromium alloys.

4. A pump rotor according to claim 1, wherein the ceramic material is aluminium oxide.

5. A pump rotor according to claim 1, wherein the grain size of the ceramic material sprayed onto the rotor body is 7.8 to 44 $\mu$m.

6. A downhole progressing cavity pump comprising a stator made of elastomeric material; and a pump rotor according to claim 1.

7. The pump rotor according to claim 1, comprising a bonding layer of molybdenum on the ferrous metal rotor body and under the ceramic layer.

8. The pump rotor according to claim 1, wherein the ceramic material is selected from the group consisting of ceramic carbides.

* * * * *